US005547793A

United States Patent [19]

Kuramoto et al.

[11] Patent Number: 5,547,793

[45] Date of Patent: Aug. 20, 1996

[54] METHOD FOR USING IMAGE SUPPORT REGENERATIVELY AND TOOL FOR FORMING IMAGE ON IMAGE SUPPORT

[75] Inventors: Shinichi Kuramoto, Numazu; Sadao Takahashi, Tokyo; Yoshiyuki Kimura, Ota-Ku; Kazuhiro Ando, Satsute; Tadashi Saito, Yokohama; Youichi Asaba, Yokohama; Kiyoshi Tanikawa, Yokohama; Yoshiaki Miyashita; Satoshi Shinguryo, both of Kawasaki, all of Japan

[73] Assignee: Ricoh Company, Ltd., Tokyo, Japan

[21] Appl. No.: 314,291

[22] Filed: Sep. 30, 1994

[30] Foreign Application Priority Data

Oct. 3, 1993 [JP] Japan ..... 5-271362

[51] Int. Cl.[6] ..... G03G 13/22

[52] U.S. Cl. ..... 430/97

[58] Field of Search ..... 401/199; 15/424; 428/211; 430/99, 97

[56] References Cited

U.S. PATENT DOCUMENTS 4,872,777 10/1989 Dalbke ..... 401/199

5,098,772 3/1992 af Strom ..... 428/211

5,110,702 5/1992 Ng et al. ..... 430/99

*Primary Examiner*—John Goodrow

*Attorney, Agent, or Firm*—Oblon, Spivak, McClelland, Maier & Neustadt, P.C.

[57] ABSTRACT

This invention provides a method for using paper repeatedly by flaking and removing an image from the paper, even if the image has been touched up on the paper with handwriting, and a preferable printing tool used in the method. The method includes the steps of touching up the image on the paper with the printing tool containing a main component of a colored thermoplastic resin particle and being formed into a stick shape by solidifying the resin particle alone or with binder resin sticking to the resin particle. The image can be formed on the paper with a liquid-applying type of printing tool having a liquid container containing a resin dispersion liquid being formed by dispersing the resin particle in a solvent. Regenerating of the paper by removing the touched-up image from the paper comprises the steps of wetting the paper through a treatment liquid such as water, and while heating the resin particle of the image, adhering the resin particle to a flaking member having a greater adherent force to the resin particle than the adherent force between the resin particle and a surface of the paper so as to flake and remove the resin particle from the surface of the paper.

3 Claims, 2 Drawing Sheets

METHOD FOR USING IMAGE SUPPORT REGENERATIVELY AND TOOL FOR FORMING IMAGE ON IMAGE SUPPORT

BACKGROUND OF THE INVENTION (1) Field of the Invention

The present invention relates to a method for using an image support regeneratively, wherein an image is repeatedly formed thereon, wherein the method comprises the steps of wetting the image support having the image formed thereon through at least one liquid selected from the group consisting of water, a solution of a surfactant, a solution of a water soluble polymer, and a solution of the surfactant and the water soluble polymer, and while heating a material forming the image, adhering the material to a flaking member having a greater adherent force to the material than the adherent force between the material and a surface of the image support so as to flake and remove the material from the surface of the image support. The present invention is also concerned with a tool for forming the image on the image support.

(2) Description of the Prior Art

Various methods for using the image support repeatedly and devices used in the method are known in the art in which a material, such as toner, for forming the image is removed from the image support, such as paper, for retaining the image formed thereon. For example, a method for removing the toner by using a solvent is known from a Japanese Laid-Open Patent Application No. 1-101576, in which a paper being fixed with the toner is dipped into the solvent for toner resin and applied with a ultrasonic vibration so as to free the toner dissolved in the solvent from a surface of the paper. Furthermore, a method for removing the toner from the paper is known from a Japanese Laid-Open Patent Application No. 4-300395, in which the solvent is adhered to a printed portion of the used paper by means of a dip, a spray or an application, and the dissolved toner is removed by means of a washing, an air aspiration, an absorbent attachment, a mechanical flake or an electrostatic aspiration.

A method for removing the toner without using the solvent is known, for example, from a Japanese laid-Open Patent Application No. 2-255195, in which a thermally fusible toner is attached to a printing material by an electrophotographic copying or a thermal transfer, wherein the printing material is formed of the image support applied with a parting agent. Then the printing material covered with a flaky material for the toner is passed between a heating roller and a pressing roller, and the flaky material is flaked after the flaky material has been cooled down so as to remove the toner attached to the flaky material from the printing material.

An eraser for removing the toner without using the solvent is known from a Japanese Laid-Open Patent Application No. 4-64472, in which the eraser comprises an endless sheet having a surface covered with fusible resin, heating and cooling rollers for supporting and advancing the endless sheet, a pressing roller for pressing paper, such as erasable paper having a surface being processed to be parted, against softened or fused thermally fusible resin, and a drive unit for driving these rollers together. Furthermore, a toner eraser is known from a Japanese Laid-Open Patent Application No. 4-82983, in which two rollers being arranged in parallel for pressing on each other and rotating so as to pass a paper through a pressed portion between the rollers, a heating unit for heating at least one of the rollers, a scratching unit for releasing the paper passing through the pressed portion from the rollers, and a flaking unit for removing the toner being adhered to the rollers from these rollers.

However, the above-described method and erasers for removing the toner without using the solvent as described above have the following disadvantages when the toner is removed from an image support formed from a normal paper on which an image has been printed wherein the normal paper has a surface on which paper fiber exists. For example, at a fixation process in the electrophotography, the toner is strongly fixed to the fiber on the surface of the image support by fusing wherein the toner contains mainly thermal fusible resin. Therefore, the paper fiber is scratched from the surface of the image support and a quality of the paper is degraded when the toner is removed from the image support. Particularly, when the flaky material, the endless sheet or the image support around the rollers is heated or pressed, a problem occurs that it may be difficult to remove the toner from the image support since the fixation between the toner and the image support can be increased.

We have described a method for flaking a toner from an image support, for example, in a Japanese Laid-Open Patent Application No. 4-255916, in which the printed image contains at least one liquid (hereinafter referred to as a treatment liquid) which is selected from the group consisting of water used for an instabilization agent, a solution of a surfactant, a solution of a water soluble polymer and a solution of the surfactant and the water soluble polymer, and a flaky member is inserted between the toner and the image support, so that the toner is adhered to the flaky member by heating or pressing and is removed from the image support with the flaky member. According to the above-mentioned method, the toner can be solely removed from the image support while preventing a paper quality of the image support from being degraded and thus the image support can be used repeatedly.

However, when an image is shaped on the image support by being touched up with a common pen such as a ballpoint pen, a pencil, an automatic pencil or a felt-tip marker, removal of the shaped image from the image support by means of the above-mentioned method for removing the toner from the image support is difficult. Therefore a problem occurs that the image support cannot be used repeatedly for forming the image thereon.

SUMMARY OF THE INVENTION

Accordingly, it is a general object of the present invention to provide a novel and useful method for using an image support repeatedly by flaking and removing a material forming an image even if the image has been touched up on the image support with handwriting.

And it is also another object of the present invention to provide a novel and useful tool used in the above-mentionedmethod.

The above-mentioned object of the present invention is achieved by a method as defined in claim 1, in which the method comprises the steps of: wetting the image support having the image formed thereon through at least one liquid selected from the group consisting of water, a solution of a surfactant, a solution of a water soluble polymer, and a solution of the surfactant and the water soluble polymer; and while heating a material forming the image, adhering the material to a flaking member having a greater adherent force to the material than the adherent force between the material and a surface of the image support so as to flake and remove the material from the surface of the image support; characterized in that the image is formed on the image support from an image-forming member containing a main component of a colored thermoplastic resin particle and being formed by solidifying the resin particle alone or with binder resin sticking to the resin particle.

The above-mentioned object of the present invention is also achieved by a method as defined in claim 2, in which the method comprises the steps of: wetting the image support having the image formed thereon through at least one liquid selected from the group consisting of water, a solution of a surfactant, a solution of a water soluble polymer, and a solution of the surfactant and the water soluble polymer; and while heating a material forming the image, adhering the material to a flaking member having a greater adherent force to the material than the adherent force between the material and a surface of the image support so as to flake and remove the material from the surface of the image support; characterized in that the image is formed on the image support from an image-forming liquid containing a main component of a colored thermoplastic resin particle and being formed by dispersing the resin particle in a solvent.

The above-mentioned object of the present invention is also achieved by a method as defined in claim 3, in which the solvent dissolves resin.

Another object of the present invention is achieved by a tool, in which the tool for forming an image on an image support and used in a method for using the image support regeneratively wherein the image is repeatedly formed thereon, wherein the method comprises the steps of: wetting the image support having the image formed thereon through at least one liquid selected from the group consisting of water, a solution of a surfactant, a solution of a water soluble polymer, and a solution of the surfactant and the water soluble polymer; and while heating a material forming the image, adhering the material to a flaking member having a greater adherent force to the material than the adherent force between the material and a surface of the image support so as to flake and remove the material from the surface of the image support; characterized in that the tool contains a main component of a colored thermoplastic resin particle and provided with an image-forming member formed by solidifying the resin particle alone or with binder resin sticking to the resin particle.

The another object of the present invention is also achieved by a tool in which the tool for forming an image on an image support and used in a method for using the image support regeneratively wherein the image is repeatedly formed thereon, wherein the method comprises the steps of: wetting the image support having the image formed thereon through at least one liquid selected from the group consisting of water, a solution of a surfactant, a solution of a water soluble polymer, and a solution of the surfactant and the water soluble polymer; and while heating a material forming the image, adhering the material to a flaking member having a greater adherent force to the material than the adherent force between the material and a surface of the image support so as to flake and remove the material from the surface of the image support; characterized in that the tool contains a main component of a colored thermoplastic resin particle and provided with an image-forming liquid being formed by dispersing the resin particle in a solvent.

Furthermore, the another object of the present invention is also achieved by a tool in which the solvent dissolves resin.

According to the present invention, the image support can be regenerated by removing the image-forming material from the image support while preventing a fibered surface from being more significantly damaged than otherwise would be damaged if known methods or tools are used.

Further, according to the present invention, the image is formed on the image support from the image-forming member containing a main component of a colored thermoplastic resin particle and being formed by solidifying the resin particle alone or with binder resin sticking to the resin particle. That is to say, the image is formed on the image support by pressing the image-forming member against the paper while preventing the resin particle from penetrating, for example, into the fiber of the image support. Thus, the image formed from the image-forming member, such as the resin particle, by being touched up can be flaked and removed from the image support in accordance with the above-mentioned method. Therefore, the present invention has an advantage in that the image support can be used repeatedly, even if the image support has the image being touched up thereon.

Furthermore, according to the present invention the image is formed on the image support from an image-forming liquid containing a main component of a colored thermoplastic resin particle and being formed by dispersing the resin particle in a solvent. Thus, the image formed from the image forming member, such as the resin particle, by being touched up can be flaked and removed from the image support in accordance with the above-mentioned method. Therefore, the present invention has an advantage in that the image support can be used repeatedly, even if the image support has the image being touched up thereon.

In addition, according to the present invention the solvent of the image-forming liquid dissolves resin. Therefore, the present invention has an advantage that a fixation of the colored thermoplastic resin particle to the image support is improved wherein the image has been touched up on the image support with the image-forming liquid.

BRIEF DESCRIPTION OF THE DRAWINGS

The above and other objects, features, and advantages of the present invention will be more apparent from the following detailed description when read in conjunction with the accompanying drawings, in which.

DESCRIPTION OF THE PREFERRED EMBODIMENTS

Figure 1:
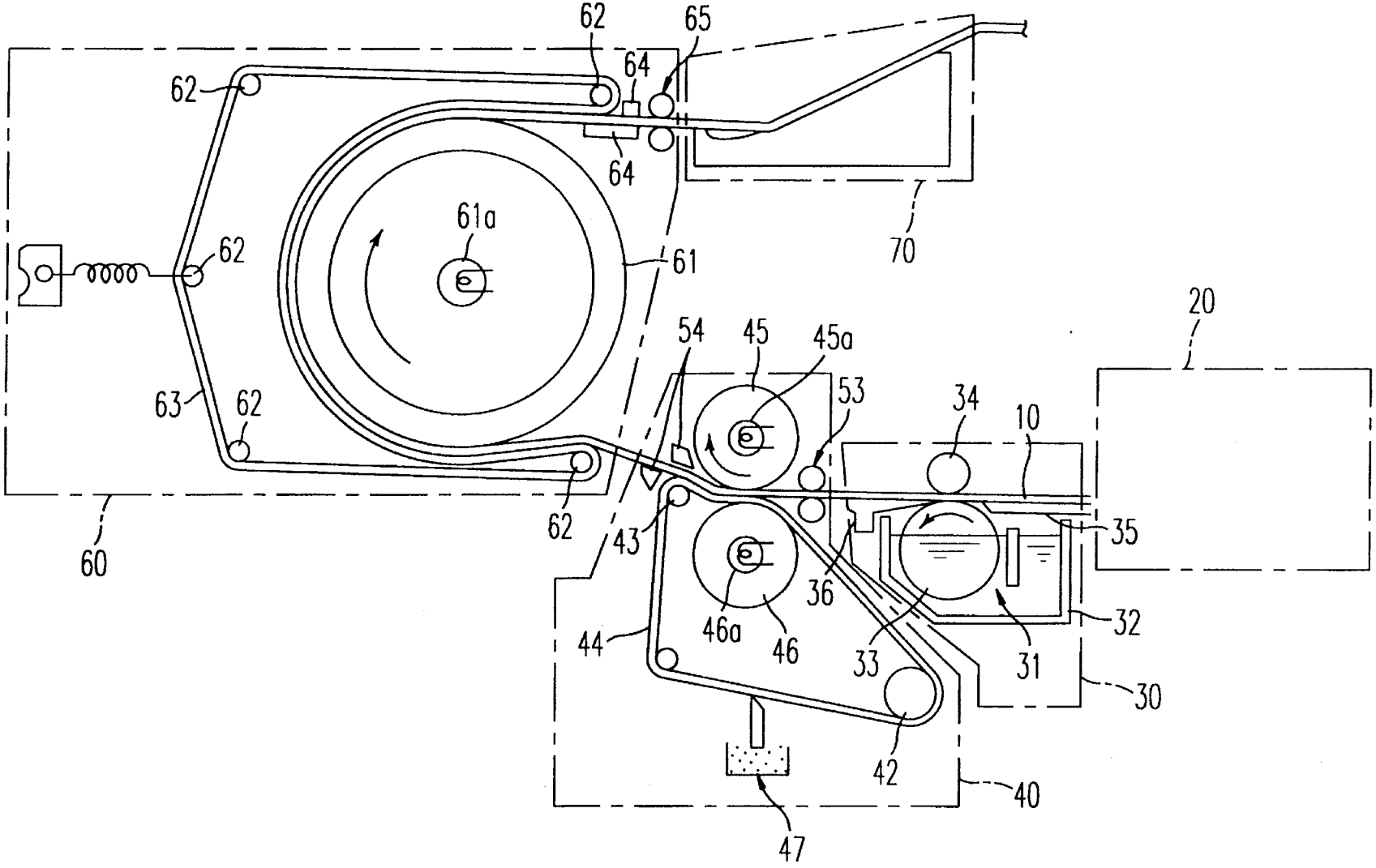
FIG. 1 is a schematic diagram of an apparatus for removing toner from an image support.

A description will now be given of an embodiment of a method according to the present invention, in which a material for forming an image shaped by touching up with a pen on an image support such as paper is removed from the paper, and the paper can be repeatedly used so as to be regenerated.

According to the method for using the paper repeatedly by removing the image forming material from the paper, the paper on which the image has been shaped is moistened with treatment liquid, the image-forming material is heated, and then the paper is contacted with a flaking member having an affinity with the image-forming material so as to remove the image-forming material from the paper.

Now it is assumed that toner is used for the material for forming the image in the method for using the paper repeatedly.

In this method for using the paper repeatedly, the paper on which a toner image is shaped is moistened with the treatment liquid, whereby a fixation between the paper and the toner is weakened. The treatment liquid is, as described above, at least one liquid which is selected from the group consisting of water, a solution of a surfactant, a solution of a water soluble polymer, and a solution of the surfactant and the water soluble polymer.

The above-mentioned surfactant promotes osmosis of water to an interface between the paper and the toner. For example, the following surfactants can be used: a normal surfactant such as an anionic surfactant (fatty acid derivative, carboxylate, sulfonate, sulfate ester salt, phosphoric ester salt, phosphonate, and so on), a cationic surfactant (amine salt, quaternary ammonium compound, quaternary ammonium compound including ester linkage amine and ether linkage, heterocyclic amine, amine derivative, benzalkonium salt, benzethonium chloride salt, pyridinium salt, imidazolium salt, sulfonium salt, polyethylene polyamine, and so on), an amphoionic surfactant (amino acid, carboxybetaine, sulfobetaine, amino sulfate ester, amino carboxylic acid, imidazoline derivative, and so on), and a nonionic surfactant (ether type, ether ester type, ester type, nitrogen type, polyhydric alcohol type, amino alcohol, poly(ethylene glycol), and so on), and a fluorine surfactant.

The water soluble polymer serves as a binder between the toner penetrating through the paper fiber and a surface of the flaking member, as described hereinafter, so as to remove the toner effectively from the paper when the toner is difficult to adhere to the surface of the flaking member. For example, the following water soluble polymers can be used: natural polymer such as starch (sweat potato starch, potato starch, tapioca starch, wheat starch, cornstarch, and so on), mannan (Konnyaku and so on), seaweed (Glue plant, agar, sodium alginic acid and so on), plant gum (Hibiscus manihot, tragacanth gum, Arabian gum, and so on), microbial gum (dextran, levan and so on) and protein (glue, gelatin, casein, colladen and so on), semisynthetic polymer such as cellulose (viscose, methyl cellulose, ethyl cellulose, hydroxyethyl cellulose, carboxymethyl cellulose and so on) and starch (soluble starch, carboxymethyl starch and dialdehyde starch), and synthetic polymer such as poly(vinyl alcohol), sodium poly(acrylic acid), poly(ethylene oxide), isobutylene-maleic anhydride and so on.

In the method for using the paper repeatedly, the toner for shaping the image on the paper which has been moistened with the treatment liquid is heated and is adhered to the flaking member having a greater adherent force to the material than the adherent force between the material and the surface of the image support so as to flake and remove the material from the surface of the image support. It is desirable that the toner is heated to be softened but not to be fused. The flaking member can have a surface formed from the same or similar resin included in the toner. The flaking member can also have a surface formed from the resin included in adhesives. Furthermore, the flaking member can have a surface formed of a metal material such as aluminium, copper, nickel or iron.

The following resins can be used as the component of the adhesives; a protein adhesive such as glue, gelatin, albumin, casein and so on; a carbohydrate adhesive such as starch, cellulose, complex polysaccharide (Arabian gum, tragacanth gum, etc.) and so on; a thermoplastic adhesive such as vinyl acetate polymer or copolymer, acrylic, ethylene copolymer, polyamide, polyester, polyurethane and so on; a rubber adhesive such as polychloroprene, nitrile rubber, regenerated rubber, SBR, natural rubber and so on, a pressure-sensitive adhesive such as acrylic and so on; and poly(ethylene terephthalate)(PET) on which titanium oxide is dispersed.

A description will now be given, with reference to FIG. 1, of an apparatus for regenerating the paper and realizing the method for using the paper repeatedly according to the present invention. A schematic diagram of the apparatus is shown in FIG. 1. As shown in FIG. 1, the regeneration apparatus comprises a feed unit 20 for containing paper 10 and feeding separately each sheet of the paper on which a toner image is shaped. The apparatus also comprises a liquid supply unit 30 for supplying treatment liquid to the paper 10 fed by the feed unit 20, a toner eraser unit 40 for removing the toner from the paper 10 supplied with the liquid, a dryer unit 60 for drying the paper 10 from which the toner has been removed and a paper-receiving unit 70 for receiving the paper 10 sent from the dryer unit 60.

Each sheet of the paper 10 is stacked on a paper feed table (not shown in FIG. 1) so that one side on which the toner image has been shaped (hereinafter referred to as a toner image side) is faced downwardly. The feed unit 20 feeds the sheet of the paper one by one from the lowest one. Since a structure and an operation of the feed unit 20 may be corresponding to those of a feed mechanism used in a conventional electrophotographic copying machine, the feed unit 20 will not be described further in detail.

The liquid supply unit 30 applies treatment liquid or an aqueous solution 31 (hereinafter referred to as a liquid) containing a surfactant to the paper 10. The liquid supply unit 30 comprises a liquid container 32 for containing liquid, an applying roller 33 being partly submerged into the liquid container 32 for supplying the liquid to the toner image side of the paper 10 by rotationally pumping the liquid from the container 32, and a restraint roller 34 for serving as a paper restraint member, the restraint roller 34 being arranged on an opposite side of the applying roller 33 with respect to a paper feed path. The applying roller 33 is driven to rotate at a rotational speed so that the liquid is retained at the opposite side of the applying roller 33 even if the paper 10 takes in a desirable amount of the liquid, specifically more than 35% by paper weight, or preferably 40 to 120% by paper weight.

The restraint roller 34, provided opposite to the applying roller 33, is spaced with a gap larger than a thickness of the paper and is driven to rotate clockwise, so that the paper 10 can be held between the restraint roller 34 and the applying roller 33 and advanced, wherein the paper 10 becomes thick by being pressed against the surface of the applying roller 33 and being supplied with the liquid.

The liquid supply unit 30 comprises a first paper guidance 35 and a second paper guidance 36. The first paper guidance 35 guides the paper 10 fed by the feed unit 20 to an interface portion between the applying roller 33 and the restraint roller 34 (hereinafter referred to as a liquid supply portion). The second paper guidance 36 guides the paper 10 passed through the liquid supply portion toward the toner eraser unit 40.

The toner eraser unit 40 comprises a belt 44 being passed around several support rollers 41, 42 and 43 for serving as a flaking member offsetting the toner (hereinafter referred to as an offset belt). The toner eraser unit 40 further comprises upper and lower heating rollers 45 and 46 being located at each side of the offset belt 44 so as to press on each other and including heating lamps 45*a* and 45*b*, respectively, and a belt cleaning device 47 for removing the toner from a surface of the offset belt 44. At least the surface of the offset belt 44 is formed from a material, such as poly(ethylene terephthalate) (PET) having titanium oxide dispersed thereon, to which the softened toner is ready to be adhered.

A portion of the offset belt 44, which portion having passed through a pressed portion of the upper and lower heating rollers 45 and 46, is passed around the small radius roller 43 which is one of the support rollers. A direction for moving of the portion of the offset belt 44 is extremely changed around the small roller 43 so that the paper 10 is separated from the offset belt 44 by extremely changing a curvature of the offset belt 44, i.e. by a curvature separation.

The upper and lower heating rollers 45 and 46 contact the toner image side of the paper 10 with the offset belt 44 and heat the toner fixed to the paper 10 so as to soften the toner. The toner is heated to the extent that the toner should not be fused at a pressed portion of the upper heating belt 45 and the offset belt 44. The upper heating belt 45 heats the toner on the toner image side of the paper 10 via the paper 10 to the extent that is close to a temperature around a softening point for the toner. If the paper 10 is heated too hot, the paper 10 is extremely dried during passing through the pressed portion between the upper heating roller 45 and the offset roller 44. This may cause a leading portion of the paper to again contact with the surface of the offset belt 44 due to a weight corresponding to the leading portion of the paper, after passing through the pressed portion and being separated by the curvature separation around the small radius roller 43. Thus, a problem may occur in that the toner having been adhered to the surface of the offset belt 44 can be transferred to the paper again. Therefore, the paper 10 is heated to the extent that some moisture remains in the paper 10, for example, by a moisture content ratio of 12 to 63% or by a liquid amount of 0.5 to 2.5 g within an A4 paper of 4 g weight, so as to prevent the toner from being adhered to the paper again. In particular, the built-in lamp 45*a* is controlled to be turned on so that the temperature of the surface of the upper heating roller 45 remains within a set temperature of 80° C. to 115° C.

The lower heating roller 46 and the upper heating roller 45 are used to soften the toner fixed to the paper 10. In this case, the paper is also heated so as not to be too hot. In particular, the built-in lamp 46*a* is controlled to be turned on so that a temperature of a surface of an flaking roller is remained within a set temperature of 70° C. to 115° C.

The toner eraser unit 40 is provided with a pair of relay rollers 53 for holding and feeding the paper 10 so that the paper 10 can be supplied to a pressing portion. The toner eraser unit 40 is further provided with upper and lower guidance members 54 for guiding the paper 10, which has passed through the pressed portion and is separated from the offset belt 44 by the curvature separation around the small radius roller 43, to the dryer unit 60.

A linear velocity of the pair of the relay rollers 53 of the toner eraser unit 40 is set to be a value higher than that of a pair of feed rollers 24 by a quantity corresponding to an increased length of the paper 10 (for example, 3%) with the liquid osmosis. In particular, the linear velocity of the pair of the feed rollers 24 is set to be the value of 49.5 mm/sec and that of the pair of the relay rollers 53 of the toner eraser unit 40 is set to be the value of 51.0 mm/sec. Furthermore, the linear velocities of the upper heating roller 45 and the offset belt 44 at the pressed portion thereof are set to be values a little higher than that of the pair of the relay rollers 53.

The dryer unit 60 may dry the paper 10 to the extent that the moisture content of the paper 10 amounts to 10% by paper weight. For example, the dryer unit 60 comprises a heating drum 61 which may be formed from aluminum and may have a built-in heating lamp 61*a* and a paper-pressing belt 63 wound around the surface of the heating drum 61 at a given angle and moving endlessly. One of support rollers 62, for example, further serves as a tension roller, as shown in FIG. 1. The dryer unit 60 further comprises upper and lower guidance members 64 for guiding the paper 10 fed from a holding portion between the heating drum 61 and the paper-pressing belt 63 and sending roller 65 for sending the paper 10 to the paper-receiving unit 70.

In the above-mentioned apparatus for regenerating the paper, the paper 10 fed from the feed unit 20 has the toner image side uniformly applied with the liquid by the liquid supply unit 30 and is sent to the toner eraser unit 40. In the toner eraser unit 40, the toner fixed to the paper is softened by the heat from the heating rollers 45 and 46, and is adhered to the surface of the offset belt 44. Then, when the paper 10 is separated from the offset belt 40 around the small radius roller belt 43, the toner adhered to the surface of the offset belt 40 is flaked and removed from the paper. The paper from which the toner has been removed is dried by the dryer unit 60 and sent to the paper-receiving unit 70. In this apparatus for regenerating the paper, the toner is flaked by applying the liquid to the paper and penetrating the liquid into the interface between the paper and the toner, therefore, the toner can be removed from the paper while preventing the paper from being damaged.

When the paper has been touched up with a common pen such as a ballpoint pen, a pencil, an automatic pencil or a felt-tip marker, ink of the pen, for example, can penetrate into the paper fiber or penetrate deeply into the paper. Furthermore, a colorant such as ink is not thermoplastic. Therefore, a problem may possibly occur that the paper touched up with the common pen using the ink cannot be regenerated even if the above-mentioned apparatus for regenerating the paper is applied to the paper, because an image formed by being touched up with the pen remains on the paper.

To overcome the above-mentioned problem, in this embodiment for realizing the method for using the paper repeatedly according to the present invention, a novel and useful image-shaping or image-printing tool for shaping an image is provided, wherein the image is formed from a material which can be removed from the paper by the above-mentioned apparatus for eliminating the toner. In this case, the image is shaped on the paper by touching up with the image shaping tool and the material forming the image is removed from the paper by the toner eraser apparatus.

The above-mentioned tool uses the image-shaping material mainly containing a colored thermoplastic resin particle (hereinafter referred to as a color resin particle). This color resin particle has the same thermal characteristics as the toner used in an electrophotographic process in the conventional machine such as PPC copying machine or LBP. For example, the color resin particle may be prepared by grinding a fused and mulled material including resin and a colorant, by dyeing a colorless resin particle produced by suspension polymerization, or by applying a colorant to a resin particle during polymerization such as suspension polymerization.

The above-mentioned printing tool formed of the color resin particle is produced, for example, by pressing and solidifying the color resin particle alone. In this case, the tool can be solidified to form a stick shape and used as the printing tool without further being processed. Otherwise the tool can be wrapped in paper or wood so as to be easily grasped in the same way for a pencil. Furthermore, a resin dispersion solution which is formed from the color resin particle and a solvent to dissolve the particle can be used to produce the printing tool. In this case, the resin dispersion solution is contained in a liquid container of a liquid-applying type of printing tool and is applied onto the paper through an applying opening. Therefore, this type of printing tool can be used as a pen such as felt-tip marker. The resin dispersion solution can be used as ink for a stamper.

A common fixing resin for the toner of the electrophotographic copying machine can be used as the above-mentioned resin included in the resin dispersion solution. In particular, the resin can be formed from at least one material selected from the group consisting of the following materials: a single polymer of styrene such as polystyrene, polychloroethylene or polyvinyltoluene, and substituent thereof; styrene copolymer such as styrene-P chlorostyrene copolymer, styrene-propylene copolymer, styrene-vinyltoluene copolymer, styrene-vinylnaphthalene copolymer, styrene-(methyl acrylate) copolymer, styrene-(ethyl acrylate) copolymer, styrene(butyl acrylate) copolymer, styrene-(octyl acrylate) copolymer, styrene-(methyl methacrylate) copolymer, styrene-(ethyl methacrylate) copolymer, styrene-(butyl methacrylate) copolymer, styrene-α-(methyl chlormethacrylate) copolymer, styrene-acrylonitrile copolymer, styrene-(vinyl methyl ether) copolymer, styrene-(vinyl methyl ketone) copolymer, styrene-butadiene copolymer, styrene-isoprene copolymer, styrene-acrylonitrile-indene copolymer, styrne-(maleic acid) copolymer, styrene-(maleic acid ester) copolymer; poly(methyl methacrylate), poly(butyl methacrylate), poly(vinyl chloride), poly(vinyl acetate), polyethylene, polypropylene, polyester, poly(vinyl butyl butyral), poly(acrylic acid) resin, rosin, denatured rosin, terpene resin, phenolic resin, aliphatic or alicyclic hydrocarbon, aromatic petroleum resin, chlorinated paraffin and paraffin wax.

All of common pigments or dyes can be used as the above-mentioned colorant. In particular, the colorant can be selected from the group consisting of the following materials: carbon black, ultramarine, nigrosine dye, aniline blue, chalco-oil blue, Du-Pont oil red, quinoline yellow, Methylene blue chloride, phthalocyanine blue, phthalocyanine green, Rhodamine 6C lake, quinacrine, benzidine yellow, Malachite green, Hansa yellow G, Malachite green hexolate, oil black, azo oil black, rose bengal, mono azo aye, dis azo dye, tris azo dye and compounds thereof.

The binder resin is selected from the group consisting of the following materials: plant wax such as paraffin wax, candelilla wax, carnauba wax, rice wax, wood wax or jojoba oil; animal wax such as honey wax, lanolin or whale wax; mineral wax such as montan wax or ozocerite; and fat and oil wax such as harden castor oil, hydroxystearic acid, fatty acid amide or phenol fatty acid ester.

The solvent is only required to not dissolve the above-mentioned color resin particle and has no further limitations. If the resin particle is dissolved in the solvent, components of the resin penetrates into the paper fiber, thus, the printed image is difficult to be flaked from the paper. In particular, the solvent is selected from the group consisting of the following materials: water; alcohol such as methanol or ethanol; diol such as ethylene glycol; ketone such as acetone or methyl ethyl ketone; ester such as butyl phthalate, bis-2-ethyl hexyl phthalate or butyl sebacate; and compounds thereof.

Furthermore, some resin can be dissolved in the solvent to aid an adhesion of the color resin particle to the paper. When the solvent is water, the resin is selected from the group consisting of the following materials: poly(vinyl alcohol), poly(vinyl pyrrolidone) or poly(acrylic acid). Otherwise, when the solvent is alcohol, the resin is selected from the group consisting of the following materials: epoxy resin of low molecules, cellulose derivative or butadiene rubber. The resin used for aiding the adhesion is only required to be soluble in the solvent and has no more requirements.

A description will now be given, with reference to FIG. 2, of an embodiment of a liquid-applying type of printing tool according to the present invention.

The liquid-applying type of printing tool comprises a liquid container 81 for containing a resin dispersion liquid 80 in which the color resin particle is dispersed, a stirring ball 82 for stirring the resin dispersion liquid 80 in the liquid container 81 to stir the resin particle uniformly, a tapered hollow member 83, a shell-shaped seal member 84, a hollow division member 85, a valve shaft 86 and a coil spring 87.

The liquid container 81 has a long and thin shell shape and is formed from synthesis resin so as to be transformed by pressing. The hollow member 83 has a liquid-applying hole 83*a* at a tip thereof and is screwed to a periphery of an opening 81*a* of the liquid container 81 at a female screw 83*b* on the opposite side of the hole 83*a*. The seal member 84 is merged to the opening 81*a* of the liquid container 81 and engaged to a side surface of the opening 81*a* at one side of a flange 84*a*.

The division member 85 is arranged within the hollow member 83 and is contacted with a tapered inner surface 83*c* of the hollow member 83 at a tapered outer surface 85*a* thereof, whereby a small space 88 is formed at the tip and within the hollow member 83. A small space, i.e. side surface 85*b*, of the division member 85 is planar and a through hole 85*c* is provided at the center of the side surface 85*b* for communicating the small space 88 with an internal space 81*b* of the liquid container 81. A concave part 85*d* is also formed around a side of the small space 88. An opening 85*e* on the opposite side of the small space 88 in the division member 85 is concentrically pressed against the opening 81*a* of the liquid container 81 via the flange 84*a* of the seal member 84 by contacting the outer surface 85*a* closely with the inner surface 83*c*. That is to say, integrally connected surfaces of the hollow member 83, the division member 85, the seal member 84 and the liquid container 81 are sealed against the liquid according to the hollow member 83 being screwed, so that the internal space 81*b* of the liquid container 81 only communicates with the small space 88 within the hollow member 83 via the through hole 85*c*.

The valve shaft 86 is provided within the hollow member 83 and is energized outwardly by the coil spring 87. A leading portion 86*a* of the valve shaft 86 is projected outwardly from the applying hole 83*a*. A valve body 86*b* at the base of the valve shaft 86 can move with respect to a valve base 83*c* located at an inside of the applying hole 83*a* so that the applying hole 83*a* can be opened or closed as required. When the tool is out of use, the valve body 86*b* is pressed against the valve base 83*c* closely so that the applying hole 83*a* can remain closed. Furthermore, a rear portion 86*c* of the valve shaft 86 operates to put limitations on a flow of the resin dispersion liquid 80 by narrowing a flow path of the resin dispersion liquid 80 from the through hole 85*c* of the division member 85 to the small space 88. A predetermined difference of diameters between the rear portion 86*c* of the valve shaft 86 and the through hole 85*c* normally extends over about 0.05 to 0.3 mm, preferably about 0.1 to 0.2 mm.

The coil spring 87 is arranged around the valve shaft 86. A leading portion of the coil spring 87 is engaged to a flange-shaped spring stopper 86*d* of the valve shaft 86 and a rear portion of the coil spring 87 is engaged to the concave part 85*d* of the division member 85. A cap 89 is provided to protect an applying tip from being damaged and to attempt to improve a sealing function.

A process to shape an image, for example, a character, on the paper 10 with the above-mentioned liquid-applying type of printing tool, comprises the steps of: removing the cap from the printing tool, pressing the leading portion 86*a* of the valve shaft 86, projecting through the applying hole 83*a*, against the paper and pushing the valve shaft 86 inwardly while countering an energy from the coil spring 87. Thus, the valve body 86*b* is released from the valve base 83*c* and at the same time a pressure for transforming the liquid container 81 is applied to the liquid container 81 with fingers grasping the printing tool as indicated by arrows in FIG. 2. Then the resin dispersion liquid 80 from the liquid container 81 flows into the paper via the through hole 85*c* and the small portion 88. Thus, the image can be formed on the paper from the resin dispersion liquid 80 in which the color resin particle has been dispersed.

Figure 2:
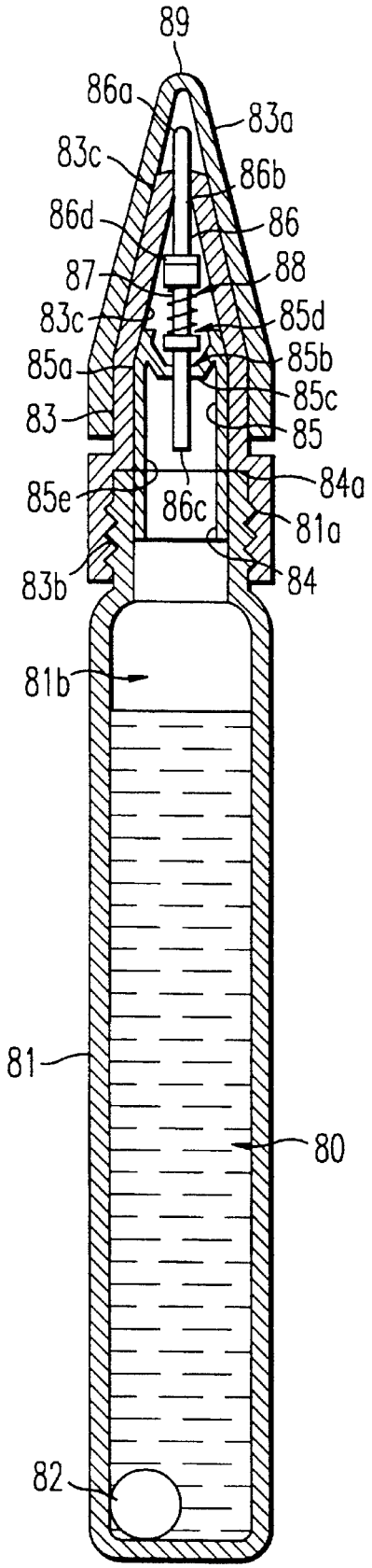
FIG. 2 is a sectional side view of a printing tool for applying liquid to an image support to print an image.

As described above, according to the embodiment of the present invention, the following types of printing tools can be used such ask a printing tool such as a printing tool made from the color resin particle solidified in the stick shape with the binder resin, a printing tool made from the color resin particle solidified in the small stick shape and wrapped in paper or wood, or a liquid-applying type of printing tool in which the resin dispersion liquid formed from the color resin particle dispersed over the solvent is contained in the liquid container 81 (see FIG. 2). The image can be formed on the paper by touching the printing tool on the paper while preventing the color resin particle from being involved with the paper fiber. Next, the paper touched up with the printing tool is passed through the toner eraser apparatus, shown in FIG. 1, and processed by the toner eraser treatment, so that the image having formed from the color resin particle on the paper can be flaked and removed from the paper. Thus, the paper can be used repeatedly by removing the image from the paper even if the image has been formed on the paper by being touched up with the printing tool.

Furthermore, in the case of the printing tool formed from the resin dispersion liquid having the color resin particle dispersed over the solvent being used, the fixation of the color resin particle on the paper is improved by dissolving some resin in the resin dispersion liquid.

Now, we will describe examples of the color resin particle and the printing tool, and results of image removal tests on the basis of the exemplary color resin particle, where part means unit weight, Mn means number-average molecular weight, Mw means weight-average molecular weight (Mw/Mn means dispersivity ratio), and Tg means glass transition point.

EXAMPLE 1

| | |
|---|---|
| styrene-n-(butyl metaacrylate) copolymer (copolymer ratio 83/17) Mn 12000, Mw/Mn 24, Tg 54° C. | 85 parts |
| carbon black | 15 parts |

These materials were mixed by a mixer and fused and mulled by two rolling mills. A mixture was rolled and cooled down, and then ground into a black resin particle having a diameter of 11 μm. The black resin particle was supplied to a press-forming machine so that the black resin particle was shaped into a stick-shaped printing tool having a size of 5ϕ×60. Pressing the black resin against the paper resulted in a black image on the paper with a low fixation. By treating the paper having the black image in the toner eraser apparatus, shown in FIG. 1, the image was flaked from the paper so that a white paper having no black images thereon was regenerated from the black-colored paper.

EXAMPLE 2

| | |
|---|---|
| styrene-n-(butyl metaacrylate copolymer) (copolymer ratio 83/17) Mn 12000, Mw/Mn 24, Tg 54° C. | 85 parts |
| carbon black | 15 parts |

These materials were mixed by a mixer and fused and mulled by two rolling mills. A mixture was rolled and cooled down, and then ground into a black resin particle having a diameter of 11 μm. The black resin particle with 50% of hexane solution containing paraffin wax (melting-point 66° to 68° C.) was inserted in a stick-formed mold, and hexane was evaporated so as to form a stick-shaped solid of the black resin, i.e. printing tool.

Pressing the black resin against the paper resulted in a fine black image on the paper with a high fixation. By treating the paper having the black image in the toner eraser apparatus, shown in FIG. 1, the image was flaked from the paper so that a white paper having no black images-thereon was regenerated from the black-colored paper.

EXAMPLE 3

| | |
|---|---|
| styrene-n-(butyl metaacrylate copolymer) (copolymer ratio 83/17) Mn 12000, Mw/Mn 24, Tg 54° C. | 85 parts |
| carbon black | 15 parts |

These materials were mixed by a mixer and fused and mulled by two rolling mills. A mixture was rolled and cooled down, and then roughly ground. A rough crush of the mixture by 10 parts was applied to a 10% of ethylene glycol by 100 parts and formed into a black resin dispersion liquid by dispersing the crush with a ball mill. The black resin dispersion liquid was contained in the liquid container 81 of the liquid-applying type of printing tool, shown in FIG. 2. Pressing the printing tool against the paper resulted in a black image on the paper with a low fixation. By treating the paper having the black image in the toner eraser apparatus, shown in FIG. 1, the image was flaked from the paper so that a white paper having a little black-colored portion thereon was regenerated from the black colored-paper. The regenerated paper was white enough to be practically used.

EXAMPLE 4

| | |
|---|---|
| polyester resin (acid value 1, OH value 50) Mn 3300, Mw/Mn 9.0, Tg 62° C. | 85 parts |
| carbon black | 15 parts |

These materials were mixed by a mixer and fused and mulled by two rolling mills. A mixture was rolled and cooled down, and then roughly ground. A rough crush of the mixture by 10 parts was applied to a bis-2-(ethylhexyl phthalate) by 100 parts dissolved 2% of poly(lauryl metaacrylate) therein, and formed into a black resin dispersion liquid by dispersing the crush with a ball mill. The black resin dispersion liquid was contained in the liquid container 81 of the liquid applying type of printing tool, shown in FIG. 2. Pressing the printing tool against the paper resulted in a black image on the paper with a high fixation. By treating the paper having the black image in the toner eraser apparatus, shown in FIG. 1, the image was flaked from the paper so that a white paper having no colored portions thereon was regenerated from the black-colored paper.

EXAMPLE 5

| | |
|---|---|
| polyester resin<br>(acid value 1, OH value 50)<br>Mn 3300, Mw/Mn 9.0, Tg 62° C. | 85 parts |
| Permanent Red FNG (SANYO SIKISO) | 8 parts |

These materials were mixed by a mixer and fused and mulled by two rolling mills. A mixture was rolled and cooled down, and then roughly ground. A rough crush the mixture by 10 parts was applied to a bis-2 -(ethylhexyl phthalate) by 100 parts dissolved 2% of poly(lauryl metaacrylate) therein, and formed into a red resin dispersion liquid by dispersing the crush with a ball mill. The red resin dispersion liquid was penetrated into cotton used in a stamper. Stamping various images with this stamper resulted in red images on the paper with a high fixation. By treating the paper having the red images in the toner eraser apparatus, shown in FIG. 1, the image was flaked from the paper so that a white paper having no colored portions thereon was regenerated from the red-colored paper.

As described above, in the embodiment of the present invention, the toner eraser apparatus, shown in FIG. 1, is used for removing the image from the paper, wherein the image is formed from a material, such as toner.

However, alternatively, a toner eraser tool which can be grasped by hand may be used. For example, the treatment liquid may be applied to the image on the paper with a liquid-applying pen comprising a treatment liquid container for containing the treatment liquid and an additional member, such as tip of the pen, for oozing the treatment liquid in the container. Then, a flaking pen can be used for flaking and removing the toner from the paper applied with the treatment liquid, wherein the flaking pen is provided with a rotatable flaking roller having a surface formed from a tacky material for flaking the toner. Otherwise, a toner eraser pen comprising a treatment liquid container, a tip of the pen, and a flaking roller can be used for applying the treatment liquid to the image on the paper, and further for flaking and removing the image from the paper.

While the method and the apparatus are described as used for fibered paper in the above-mentioned embodiment, the present invention is not limited to an application to the fibered paper and can apply to an image support having at least a surface being fibered. Therefore, the present invention can apply to the image support such as lamination, for example, formed from a plastic base sheet and a surface material layer of paper. Furthermore, the present invention is not limited to the image support having a fibered structure and can apply to the image support on which the image can be formed from the color resin particle.

Further, the present invention is not limited to the above-described embodiments, and variations and modifications may be made without departing from the scope of the present invention.

What is claimed is:

1. A method for using an image support regeneratively, comprising the steps of:

(a) forming an image material on an image support from an image-forming member, said image-forming member containing a main component of colored thermoplastic resin particles, wherein said image is formed by solidifying said thermoplastic resin particles alone or by solidifying said thermoplastic resin particles together with a binder resin;

(b) wetting said image support having said image material formed thereon with at least one liquid selected from the group consisting of water, a solution of a surfactant, a solution of a water soluble polymer and a solution of a surfactant and a water soluble polymer;

(c) heating said wetted image support having said image material formed thereon and adhering to said heated image material on said image support a flaking member having a greater adherent force for said heated image material than the adherent force between said heated image material and a surface of the image support; and (d) flaking said flaking member adhered to said image material from said image support.

2. A method for using an image support regeneratively, comprising the steps of:

(a) forming an image material on an image support from an image-forming member, said image-forming member containing a main component of colored thermoplastic resin particles dispersed in a solvent, wherein said image is formed by said thermoplastic resin particles in a solvent;

(b) wetting said image support having said image material formed thereon with at least one liquid selected from the group consisting of water, a solution of a surfactant, a solution of a water soluble polymer and a solution of a surfactant and a water soluble polymer;

(c) heating said wetted image support having said image material formed thereon and adhering to said heated image material on said image support a flaking member having a greater adherent force for said heated image material than the adherent force between said heated image material and a surface of the image support; and (d) flaking said flaking member adhered to said image material from said image support.

3. The method of claim 2, wherein said thermoplastic resin particles are dissolved in said solvent.

* * * * *